United States Patent [19]

Marshall

[11] Patent Number: 4,873,144

[45] Date of Patent: Oct. 10, 1989

[54] FIBER FOR COMPOSITE REINFORCEMENT WITH ANTI-BLOCKING FINISH

[75] Inventor: Robert M. Marshall, Chester, Va.

[73] Assignee: Allied-Signal Inc., Morris Township, Morris County, N.J.

[21] Appl. No.: 794,366

[22] Filed: Nov. 4, 1985

[51] Int. Cl.[4] ..... D02G 3/00

[52] U.S. Cl. ..... 428/395; 428/361; 428/375; 428/288; 428/224; 428/480

[58] Field of Search ..... 428/375, 378, 394, 395, 428/361, 288, 480

[56] References Cited

U.S. PATENT DOCUMENTS

| | | | |
|---|---|---|---|
| 3,630,259 | 12/1971 | Brignac | 428/357 |
| 3,850,658 | 11/1974 | Gomez et al. | 117/7 |
| 4,156,073 | 5/1979 | Login | 428/395 |
| 4,371,658 | 2/1983 | Marshall et al. | 524/585 |
| 4,477,525 | 10/1984 | Login | 428/395 |

FOREIGN PATENT DOCUMENTS

| | | | |
|---|---|---|---|
| 682354 | 3/1964 | Canada | 428/484 |

*Primary Examiner*—Lorraine T. Kendell

[57] ABSTRACT

High tenacity reinforcing fiber, selected from the group consisting of polyester, aliphatic polyamide, aramid, and combinations thereof, is treated with a finish composition comprising (a) an aqueous solution of carboxyl-terminated, oil-free alkyd resin which is the reaction product of at least one aliphatic glycol containing 2 to 12 carbons with a combination of aromatic di- and tri-functional carboxylic acid and, optionally, unsaturated aliphatic acids, said alkyd resin polymerized below its gel point, and (b) an aqueous emulsion of oxidized polyethylene, said oxidized polyethylene being present in the finish composition in an amount sufficient to provide enhanced anti-blocking properties for the treated fiber.

15 Claims, No Drawings

FIBER FOR COMPOSITE REINFORCEMENT WITH ANTI-BLOCKING FINISH

BACKGROUND OF THE INVENTION

1. Field of the invention

The present invention relates to a finish composition for a high tenacity synthetic fiber for reinforcing plastic composites, the fiber treated with the composition, and reinforced plastic composites incorporating the treated fiber.

2. Description of Related Art

Synthetic fibers in staple or filamentary form, and fabrics produced therefrom, are known for polymer reinforcement. Typical of the fibrous reinforcements are glass, polyester, polyamide (nylon and aramid) and polyolefin fibers. Conventional matrix resins include thermoplastics, such as nylon and polyolefins, and thermosetting materials, such as epoxy and unsaturated polyester resins. In a composite structure the adhesion between the reinforcing fiber and matrix is a determining factor in the load sharing ability of the composite.

U.S. application Ser. No. 631,978, filed July 18, 1985, discloses a high tenacity reinforcing fiber selected from the group consisting of polyester, aliphatic polyamide and combinations thereof, for reinforcing composites. The reinforcing fiber is treated with a composition comprising an aqueous solution of carboxyl-terminated, oil-free alkyd resin which is the reaction product of at least one aliphatic glycol containing 2 to 12 carbons with a combination of aromatic di- and trifunctional carboxylic acids. Optionally, unsaturated aliphatic acids may be included with the carboxylic acids. These alkyd resins are polymerized below their gel points, that is the degree of esterification is generally maintained below about 90 percent.

Replacement of glass fiber, or a portion of the glass fiber, in a reinforced composite with the synthetic fiber treated as disclosed above has been shown to provide great improvement in notched impact strength of the resulting composite.

The fiber so treated additionally has been found to possess a high degree of fiber bundle integrity. Fiber bundle integrity is the degree to which the individual filaments adhere to each other. The main benefit of a low integrity fiber is that it enables good dispersion of single filaments throughout a resin matrix. This even distribution results in a homogeneous reinforced composite, a direct result of which is an improved cosmetic appearance. However, in operations where high speed cutting, on the order of 500 feet/minute (about 150 m/min) or higher, of the fiber is required, a low integrity fiber tends to fluff or cottonball and jam up the cutter. A high integrity fiber, readily cut a high speed and which does not ball-up within the reinforced composite, is therefore desirable.

However, additional improvement in the finish composition is desirable. It has been found that when the finish composition discussed above is applied to high tenacity synthetic filamentary yarn, and the treated yarn is packaged for customer use, blocking problems may result from the packaging and storage of the treated yarn. By blocking problems it is meant that the tackiness of the finished yarn causes yarn filaments in adjacent yarn bundles to stick together on the package. Upon removing the yarn from the package, filaments from adjacent bundles stick to the yarn being removed, causing production problems for the customer.

SUMMARY OF THE INVENTION

High tenacity reinforcing fiber, selected from the group consisting of polyester, aliphatic polyamide, aramid, and combinations thereof, is treated with a finish composition comprising (a) an aqueous solution of carboxyl-terminated, oil-free alkyd resin which is the reaction product of at least one aliphatic glycol containing 2 to 12 carbons with a conbination of aromatic di- and trifunctional carboxylic acid and, optionally, unsaturated aliphatic acid, said alkyd resin polymerized below its gel point, and (b) an aqueous emulsion of oxidized polyethylene, said oxidized polyethylene being present in the finish composition in an amount sufficient to provide enhanced anti-blocking properties for the treated fiber.

DESCRIPTION OF THE PREFERRED EMBODIMENT

The present invention is best characterized as an improvement of U.S. application Ser. No. 631,978, filed July 18, 1985, and incorporated herein by reference. By incorporation of oxidized polyethylene into the aqueous composition taught therein, a superior finish composition is obtained for high tenacity reinforcing fiber suitable for use as reinforcement in composites.

The reinforcing fiber to be treated includes synthetic fiber selected from the group consisting of polyester, aliphatic polyamide, aramid, and combinations thereof. Preferred polyester fibers are the linear terephthalate polyesters including poly(ethylene terephthalate), poly(ethylene terephthalate/5-chloroisophthalate) (85/15), poly(ethylene terephthalate/5-[sodium sulfo]-isophthalate) (97/3), poly(cyclohexane-1,4-dimethylene terephthalate), and poly(cyclohexane-1,4-dimethylene terephthalate/hexahydroterephthalate) (75/25).

Suitable reinforcing polyamides include, for example, those prepared by condensation of hexamethylene diamine and adipic acid, condensation of hexamethylene diamine and sebacic acid known as nylon 6,6 and nylon 6,10, respectively, condensation of bis(para-aminocyclohexyl)methane and dodacanedioic acid, or by polymerization of 6-caprolactam, 7-aminoheptanoic acid, 8-caprylactam, 9-aminopelargonic acid, 11-aminoundecanoic acid, and 12-dodecalactam, known as nylon 6, nylon 7, nylon 8, nylon 9, nylon 11, and nylon 12, respectively.

A preferred polyester reinforcing fiber is polyethylene terephthalate, characterized by a thermal shrinkage of up to about 11 percent, preferably 3 percent or less; an elongation of from about 10 to 28, preferably 14 to 24 percent; a modulus after cure of at least about 60, preferably 70 to 90 grams per denier; and a tenacity of at least 5.5, preferably 7 to 9 grams per denier. By modulus after cure is meant the modulus of the fiber after exposure in an unconstrained state to curing temperatures of the composite.

The present invention also relates to a fiber reinforced plastic composite comprising a resin matrix and the described reinforcing fiber. The resin matrix may include thermosetting or thermoplastic (including polyolefin) resins. Suitable thermosetting resins include polyester (preferably unsaturated), epoxy, or vinyl ester resin systems, and thermosetting polyurethane systems. Suitable thermoplastic resin systems include polyvinyl chloride, polyethylene, polypropylene, polystyrene, polyvinyl alcohol, polyamide, and polyurethane-any thermoplastic having a lower melting point than that of the fiber.

The fiber reinforced plastic composite may advantageously additionally contain glass fiber in combination with the synthetic fiber of this invention.

The finish composition of the present invention is prepared by preparing the aqueous solution of carboxyl-terminated oil-free alkyd resin such as described in U.S. application Ser. No. 631,978. The carboxyl-terminated, oil-free alkyd resin is the reaction product of at least one aliphatic glycol containing 2 to 12 carbons with a combination of aromatic di- and trifunctional carboxylic acid. Optionally, unsaturated aliphatic acids may be included with the carboxylic acid. These alkyd resins are polymerized below their gel points, that is the degree of esterification is generally maintained below about 90 percent. Suitable aliphatic glycols include ethylene glycol, diethylene glycol, triethylene glycol, propylene glycol, tetraethylene glycol, butane diol, butene diol, butyne diol, and combinations thereof. Suitable aromatic carboxylic acids include orthophthalic acid, orthophthalic anhydride, isophthalic acid, terephthalic acid, trimellitic acid, trimellitic anhydride, 2,6-naphthalene dicarboxylic acid, 4,4'-diphenyl-dicarboxylic acid, 2,6-pyridene dicarboxylic acid, p-hydroxylmethyl benzoic acid, 5-tert-butyl isophthalic acid, bimesitylene-4,4'-dicarboxylic acid, and combinations thereof. When the combination of carboxylic acids also includes unsaturated aliphatic acid, it is preferably selected from the group consisting of maleic acid, maleic anhydride, fumaric acid and combinations thereof.

Preferred solutions include:

(a) a salt, preferably ammonium and sodium in a 50/50 ratio, solution of the condensation polymer consisting essentially of:

diethylene glycol, preferably about 45 to 55 moles, and most preferably about 49.8 moles;

isophthalic acid, preferably about 15 to 25 moles, and most preferably about 21.3 moles;

terephthalic acid, preferably about 15 to 25 moles, and most preferably about 21.4 moles; and trimellitic anhydride, preferably about 5 to 10 moles, and most preferably about 7.5 moles.

(b) a salt, preferably ammonium, solution of the condensation polymer consisting essentially of:

diethylene glycol, preferably about 35 to 40 moles, most apreferably about 37.4 moles;

propylene glycol, preferably about 10 to 20 moles, most preferably about 14.6 moles;

maleic anhydride, preferably about 2.5 to 5 moles, most preferably about 3.8 moles;

isophthalic acid, preferably about 15 to 20 moles, most preferably about 17.9 moles;

terephthalic acid, preferably about 15 to 20 moles, most preferably about 16.1 moles; and trimellitic anhydride, preferably about 5 to 15 moles, most preferably about 10.2 moles.

(c) a solution of the condensation polymer consisting essentially of:

diethylene glycol, preferably about 5 to 10 moles, most preferably about 7 moles;

isophthalic acid, preferably about 5 to 10 moles, most preferably about 6 moles; and trimellitic anhydride, preferably about 0 to 3 moles, most preferably about 1.05 moles.

(d) a solution of the condensation polymer consisting essentially of:

propylene glycol, preferably about 3 to 8 moles, most preferably about 4 moles;

isophthalic acid, preferably about 0 to 3 moles, most preferably about 1 mole;

trimellitic anhydride, preferably about 0 to 3 moles, most preferably about 1 mole; and maleic anhydride, preferably about 0 to 3 moles, most preferably about 1 mole.

An emulsion of oxidized polyethylene is added to the aqueous solution of carboxyl-terminated, oil-free alkyd resin. Oxidized polyethylene wax materials suitable for use include low molecular weight polyethylene homopolymers which have an average molecular weight of less than about 5000, determined by vapor phase osmometry using phenetol as solvent. Preferably, the number average molecular weight is about 1000 to 4000 and most preferably about 1500 to 2500. These polyethylenes have preferably been oxidized to an acid number of about 10 to 35, more preferably about 12 to 28 and most preferably about 12 to 28 and most preferably about 13 to 17. These oxidized polyethylenes preferably have a softening point as determined by ASTM E-28 of about 85° to 145° C., more preferably about 95° to 140° C. and most preferably about 98° to 115° C. Preferably, such oxidized polyethylenes have a Brookfield viscosity at 140° C. of about 120 to 300 centipoises (cps) and most preferably about 170 to 250 cps.

The oxidized polyethylene wax is emulsified in water by known methods. See, for example, U.S. Pat. Nos. 3,850,658 to Gomez et al. and 4,371,658 to Marshall et al.

The finish composition of the present invention preferably comprises about 2 to 20, more preferably about 5 to 15 weight percent of the oxidized polyethylene. It has also been found that the composition may advantageously contain a small amount, on the order of 0.1 to 5 weight percent of a surfactant such as sulfated peanut oil.

EXAMPLE 1

A salt solution of ammonium and sodium in a 50/50 ratio of the condensation polymer consisting of 49.8 moles diethylene glycol in conjunction with 21.3 moles isophthalic acid, 21.4 moles terephthalic acid, 21.4 moles terephthalic acid and 7.5 moles trimellitic anhydride is prepared as a control finish composition. The control finish composition is an aqueous solution of 25% solids.

Finish composition A is prepared by addition to the control composition 10 wt. percent Discosoft 567 20% polyethylene emulsion available from Calloway Chemical Company.

Finish composition B is prepared by addition to the control composition 10 wt. percent Discosoft 567 polyethylene emulsion and 2 wt. percent Standopol 1610, sulfated peanut oil available from Henkel Corporation.

EXAMPLE 2

To demonstrate improvement in blocking properties, the control, composition A, and composition B are each cast on polyester film at a thickness of 0.006 inches with a draw down bar and dried at 115° C. for 3 minutes. After drying the film was folded on itself and placed under a 2 kgm. weight for 24 hours. The force to separate the film was measured, the control required 26 gm. of force, composition A required 5 gm. of force, composition B required 0 gm. of force.

EXAMPLE 3

High tenacity polyethylene terephthalate (PET) yarn is passed across a kiss roll for application of finish composition to achieve a 5 percent solids pickup, based on the yarn weight. Yarn samples are prepared in this manner for each of the control finish, composition A, and composition B described in Example 1. The yarn samples are cut into ½ inch (1.3 cm) staple length and are compounded into a 20 percent load reinforced bulk molding compound compression composite with polyester resin matrix formulation, the resin matrix plus reinforcement consisting of 20 weight percent PET staple, 18.33% isophthalic polyester resin (MR 14017 USS Chemicals), 0.31% tert-butyl (perbenzoate), 0.12% promoter, 0.01% inhibiter solution (butyated hydroxy toluene and styrene), 1.30% zinc stearate, 52.57% aluminum trihydrate, 1.50% pigment (CM 7106 Red by Plastic Colors). The composite properties for each of the control compositon A, and composition B are expected to be comparable.

What is claimed is:

1. A high tenacity reinforcing fiber selected from the group consisting of polyester, aliphatic polyamide, and combinations thereof, for reinforcing plastic composites, said fiber being coated with a composition comprising:

(a) an aqueous solution of carboxyl-terminated, oil-free alkyd resin consisting essentially of the reaction product of at least one aliphatic glycol containing 2 to 12 carbons with a combination of aromatic di- and trifunctional carboxylic acids, said resin having a degree of esterification below the gel point of the resin to enhance stiffness of the fiber for cutting, and (b) an aqueous emulsion of oxidized polyethylene, said oxidized polyethylene being present in an amount sufficient to provide enhanced anti-blocking properties to the coated fiber.

2. The fiber of claim 1 wherein the aliphatic glycol is selected from the group consisting of ethylene glycol, diethylene glycol, triethylene glycol; propylene glycol, tetraethylene glycol, butane diol, butene diol, butyne diol, and combinations thereof and the aromatic carboxylic acid is selected from the group consisting of orthophthalic acid, orthophthalic anhydride, isophthalic acid, terephthalic acid, trimellitic acid, trimellitic anhydride, 2,6-naphthalene dicarboxylic acid, phenylindane dicarboxylic acid, trimesic acid, 4,4'-diphenyl-dicarboxylic acid, 2,6-pyridine dicarboxylic acid, p-hydroxymethyl benzoic acid, 5-tert-butyl isophthalic acid, bimesitylene-4-4'-dicarboxylic acid, and combinations thereof.

3. The fiber of claim 2 wherein said oxidized polyethylene is present in an amount of 2 to 20 weight percent of said composition.

4. The fiber of claim 3 wherein said combination of aromatic carboxylic acids additionally comprises an unsaturated aliphatic acid selected from the group consisting of maleic acid, maleic anhydride, fumaric acid, and combinations thereof.

5. The fiber of claim 3 wherein said composition additionally comprises 0.1 to 5 weight percent of sulfate peanut oil.

6. The fiber of claim 5 wherein said fiber is treated with a sufficient amount of the composition to achieve at least about 1 percent solids pickup, wherein the aliphatic glycol is diethylene glycol and wherein the aromatic carboxylic acid is a combination of isophthalic acid, terephthalic acid and trimellitic anhydride.

7. The fiber of claim 6 wherein the solids pickup is about 3 to 6 weight percent, wherein the solution (a) consists essentially of a salt solution of the condensation polymer consisting essentially of about 45 to 55 moles of diethylene glycol in conjunction with about 15 to 25 moles of isophthalic acid, about 15 to 25 moles of terephthalic acid and about 5 to 10 moles of trimellitic anhydride.

8. The fiber of claim 5 wherein the fiber is coated with a sufficient amount of the composition to achieve at least about 1 weight percent solids pickup, wherein the aliphatic glycol is a combination of diethylene glycol and propylene glycol, and wherein the aromatic carboxylic acid is a combination of isophthalic acid, terephthalic acid, and trimellitic anhydride, and wherein said combination of carboxylic acids additionally comprises maleic anhydride.

9. The fiber of claim 8 wherein the solids pickup is about 3 to 6 weight percent, wherein the solution (a) consists essenctially of a salt solution of the condensation polymer consisting essentially of about 35 to 40 moles of diethylene glycol, about 10 to 20 moles of propylene glycol, about 2.5 to 5 moles of maleic anhydride, about 15 to 20 moles of isophthalic acid, about 15 to 20 moles of terephthalic acid and about 5 to 15 moles of trimellitic anhydride.

10. The fiber of claim 5 wherein the fiber is coated with a sufficient amount of the composition to achieve at least about 1 weight percent solids pickup, wherein the aliphatic glycol is diethylene glycol, and wherein the aromatic carboxylic acid is a combination of isophthalic acid and trimellitic anhydride.

11. The fiber of claim 10 wherein the solids pickup is about 3 to 6 weight percent, wherein the solution consists essentially of a condensation polymer consisting essentially of about 5 to 10 moles of diethylene glycol, about 5 to 10 moles isophthalic acid, and about 0 to 3 moles trimellitic anhydride.

12. The fiber of claim 5 wherein the fiber is coated with a sufficient amount of the composition to achieve at least about 1 weight percent solids pickup, wherein the aliphatic glycol is propylene glycol, and wherein the aromatic carboxylic acid is a combination of isophthalic acid and trimellitic anhydride, and wherein said combination of carboxylic acids additionally comprises maleic anhydride.

13. The fiber of claim 12 wherein the solids pickup is about 3 to 6 weight percent, wherein the solution consists essentially of a condensation polymer consisting essentially of about 3 to 8 moles of propylene glycol, about 0 to 3 moles of isophthalic acid, about 0 to 3 moles of trimellitic anhydride and about 0 to 3 moles of maleic anhydride.

14. The fiber of claim 7 wherein the fiber is polyester which is characterized by a thermal shrinkage of up to about 11 percent, an elongation of from about 10 to 28 percent, and a modulus after cure of at least about 60 grams per denier.

15. The fiber of claim 14 wherein the polyester fiber is characterized by a tenacity of about 7 to 9 grams per denier, a thermal shrinkage of at most about 3 percent, an elongation of about 14 to 24 percent and a modulus after cure of about 70 to 90 grams per denier.

* * * * *